US010507641B2

(12) United States Patent
Gonzalez Sanchez et al.

(10) Patent No.: US 10,507,641 B2
(45) Date of Patent: Dec. 17, 2019

(54) INK SUPPLY DEVICE

(71) Applicant: Hewlett-Packard Development Company, L.P., Houston, TX (US)

(72) Inventors: Segi Gonzalez Sanchez, Anasco, PR (US); Luis E. Rodriguez Vargas, Mayaguez, PR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/095,594

(22) PCT Filed: Apr. 22, 2016

(86) PCT No.: PCT/US2016/028844
§ 371 (c)(1),
(2) Date: Oct. 22, 2018

(87) PCT Pub. No.: WO2017/184163
PCT Pub. Date: Oct. 26, 2017

(65) Prior Publication Data

US 2019/0091991 A1 Mar. 28, 2019

(51) Int. Cl.
*B41J 2/175* (2006.01)
*B41F 31/02* (2006.01)

(52) U.S. Cl.
CPC ..... *B41F 31/02* (2013.01); *B41J 2/175* (2013.01); *B41J 2/17513* (2013.01); *B41J 2/17553* (2013.01); *B41J 2002/17516* (2013.01); *B41P 2231/20* (2013.01)

(58) Field of Classification Search
CPC .... B41J 2/175; B41J 2/17513; B41J 2/17553; B41J 2/18; B41J 2/17523; B41J 2/17546; B41J 2/17556; B41J 2/17596
See application file for complete search history.

(56) References Cited

U.S. PATENT DOCUMENTS

| | | | |
|---|---|---|---|
| 5,857,952 | A | 1/1999 | Gilbert |
| 7,258,960 | B2 | 8/2007 | Ohira et al. |
| 7,828,425 | B2 | 11/2010 | Kang et al. |
| 7,984,980 | B2 | 7/2011 | Kachi et al. |

(Continued)

FOREIGN PATENT DOCUMENTS

| | | |
|---|---|---|
| CN | 203510975 | 4/2014 |
| JP | 2011156859 A | 8/2011 |
| KR | 10-1306005 B1 | 9/2013 |

OTHER PUBLICATIONS

Roland DG Corporation, "XC-540MT—Special Color Ink Guide," (Research Paper), 2009, 48 pages, Available at Http//support.rolanddga.com/docs/documents/departments/technical%20services/manuals%20and%20guides/xc-540mt_use2_en_r1.pdf.

*Primary Examiner* — Juanita D Jackson

(74) *Attorney, Agent, or Firm* — International IP Law Group PLLC

(57) ABSTRACT

A system and method for supplying ink can include an ink supply device with a first end and a second end located along an axis on opposite sides of the ink supply device. In an example, the first end is frustum shaped, and the second end is frustum shaped. In an example, a first ink connector can be attached to the first end. In an example, a second ink connector can be attached to the second end. In an example, a pump can be connected to the second ink connector to move ink accumulating in the second end through the second ink connector into the ink supply system.

20 Claims, 6 Drawing Sheets

100

(56) References Cited

U.S. PATENT DOCUMENTS

| | | | | |
|---|---|---|---|---|
| 8,348,399 | B2 | 1/2013 | Gengrinovich | |
| 8,939,571 | B2 | 1/2015 | Sato et al. | |
| 2006/0209140 | A1 | 9/2006 | Nagai | |
| 2008/0273046 | A1* | 9/2008 | Ishinaga et al. | 347/6 |
| 2008/0297546 | A1 | 12/2008 | Lee et al. | |

* cited by examiner

100

200

300

400

500

600

INK SUPPLY DEVICE

BACKGROUND

Ink can include powdered pigments and pigments that are dissolved or suspended in a liquid. Powdered pigments and pigments that are dissolved or suspended in a liquid can settle or precipitate, respectively. Ink can be stored in a supply device and provided to a printer or other ink consumption device. In some examples, ink can be for use in three dimensional forms and during application can dispensed through a print head of a printer and supplied from an ink supply device.

BRIEF DESCRIPTION OF THE DRAWINGS

Certain examples are described in the following detailed description and in reference to the drawings, in which.

DETAILED DESCRIPTION OF SPECIFIC EXAMPLES

As discussed above, ink can include powdered dry pigment that can settle and ink that can be dissolved or suspended in a liquid. The settling of a powdered ink or the precipitates of pigment in wet ink can make pumping or movement of the ink difficult. For example, in liquid based systems, inks with heavy pigment particles dissolved or suspended in a liquid may not be easily kept in suspension. These heavier or hard to dissolve inks can precipitate in solid form out of the liquid. These solid particles can settle over time to the bottom of an ink supply device. The settling of ink, whether dry or liquid based can challenge the movement of the ink and also change an optical density of the ink. Settling of ink can also affect an ink shelf life unless some method is used to re-disperse the settled particles and to keep them dispersed afterwards. In an example, these particles are pigment particles.

The re-agitation, re-dispersion, and unsettling of ink can include mechanical agitation of the supply using vibration generating devices. Manual agitation of the supply can include a user physically opening or manipulating an ink supply device to move the ink around. Although simple, the effort to achieve a distributed and unsettled ink result through manual agitation can be time consuming and imprecise. Mechanical or manual agitation can also cause problems with the printer being accessed and moved. Printers can be sensitive to vibration. Therefore systems with mechanical or manual agitation can use additional components, complexity, and expense to offset these and other effects.

In the present disclosure, the ink supply device and system can be designed to significantly reduce the time and effort to re-disperse a settled ink. Further, the present disclosure outlines geometry of an ink supply device to decrease time to unsettle any settled ink when compared to present ink supply devices. In an example, the ink supply device can include a double frustum. A double frustum can include two frustum shapes facing each other on their largest base in vertical orientation. The frustum shapes can be given to the ends of an ink supply device. These ends can have ink connectors on the top and bottom of the ink supply device. The ink connectors can allow ink, whether dry or liquid based, to flow from outside the ink supply device to the inside. Similarly, the ink connectors can allow ink, whether dry or liquid based, to flow from inside of the ink supply device to the outside. In an example, the ink can flow through the ink connectors when a pressure is applied to the ink by a pump. Once initially re-dispersed, optical density of ink can be maintained through the presently disclosed techniques.

Figure 1:
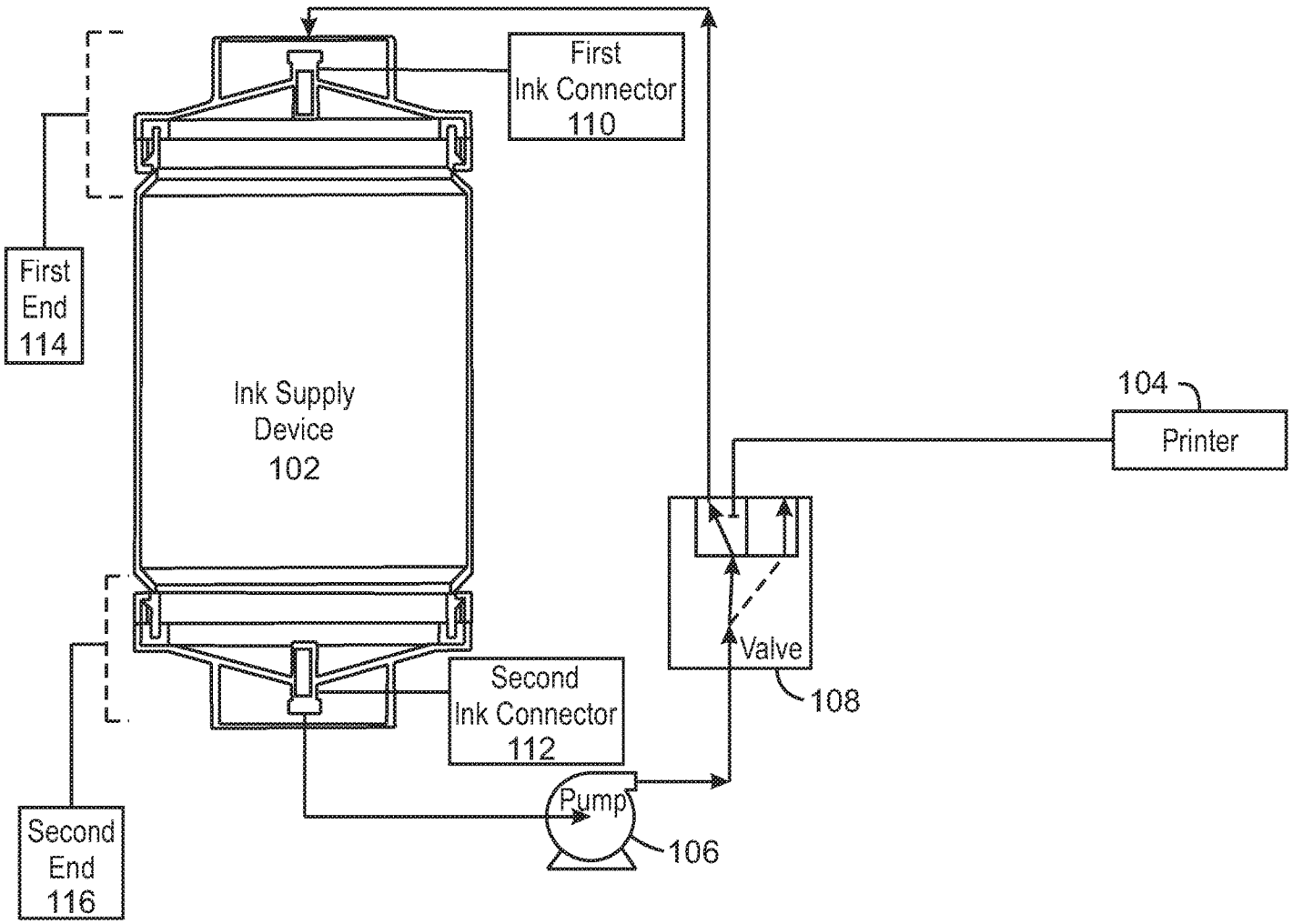
FIG. 1 is a schematic diagram of an example of an ink supply system.

FIG. 1 is a schematic diagram of an example of an ink supply system 100. The schematic here includes arrows to show, in part, a direction of ink and particle flow.

The ink supply system 100 can include an ink supply device 102. The ink supply device can include an area to hold ink. In an example, the ink from an ink supply device can be held for use in a printer 104. In an example, the movement of the ink from the ink supply device 102 to the printer 104 can be, in part, due to pressure supplied by a pump 106. Ink movement from an ink supply device 102 can also be through passive fluid flow dynamics in an ink supply system 100.

A valve 108 can operationally sit between an ink supply device 102 and the printer 104. The valve 108 can have a first position and second position. The first position first position of the valve 108 can be to route ink back to the ink supply device 102. The second position of the valve 108 can be to route ink to the printer 104.

The ink supply device 102 can have a first ink connector 110 and a second ink connector 112. As discussed above, the first ink connector 110 can allow ink to flow from the valve 108 back to the inside of the ink supply device 102. The second ink connector 112 can allow ink to flow from inside the ink supply device 102 to the valve 108 or printer 104 as a result of pressure exerted by the pump 106. In an example, the pump 106 may not be present. In an example, movement of ink to a printer can be accomplished based on passive pressure of the ink and particles in the ink supply system 100. Although the ink connectors are referred to as a first ink connector 110 and a second ink connector 112, these ink connectors can be interchangeable with one another in certain embodiments. In an example, the ink supply device 102 can vertically symmetrical and the ink connectors can be bi-directional. In an example, bi-directional for ink flow through ink connectors can allow the ink supply device 102 to be flipped and maintain function as presently shown. Further, for ink and particles to pass through in either direction of the ink connectors a threshold pressure may be reached to enable the movement of ink. For example, if flipped, the second ink connector 112 could be on top and accept returning ink from the valve 108. Similarly in an example, if flipped, the first ink connector 110 can be on bottom and allow ink, and settled particles, to flow from the bottom of the ink supply device 102 towards the pump 106, valve 108, and printer 104.

The ink supply device 102 can have a first end 114 and a second end 116. The second end 116 can be shaped to funnel settled ink towards the second ink connector 112 for re-circulation, re-distribution, agitation, and withdrawal for use in the printer 104. In an example, the second end 116 can be frustum shaped. A frustum shape can be the geometric portion of a solid, like a cone or pyramid, that lies between two parallel planes cutting the solid. In an example, the plane sections of a frustum can be a floor or base of the frustum. A frustum can be circular if it has a circular base. A frustum can be rectangular if the frustum has a square base For example, if the ink supply device 102 has a cylindrical shape, the frustum shape of the second end 116 can be a conic frustum shape or a circular frustum.

The second end 116 of the ink supply device 102 can be a frustum as the frustum shape can act as a funnel for settled and settling particles. In an example, the funneling of a frustum can direct these particles towards the second ink connector 112 where they can be pumped or sucked from the ink supply device 102. Once out of the bottom of the ink supply device 102, the ink can be recirculated through the valve 108 back to the top of the ink supply device 102. At the top of the ink supply device 102, the ink can be replaced into the ink supply device in a more dispersed density. In an example, the increased dispersion of the ink can be from agitation of settled ink particles back to the top of the ink supply device 102.

As discussed above, the interior shape of the first end 114 and the second end 116 can be frustum shaped, and together double frustum shaped. In an example, when a first end 114 and a second end 116 are frustum shaped, the ink supply device 102 can be reversed and flipped and maintain function. In a flipped ink supply device 102 with a double frustum, the first end 114 can also be at the bottom of the ink supply device 102 and continue to provide funneling of settled ink towards an ink connector. In an example, this interchangeability can lead to fewer incorrect installations of the ink supply device 102. In another example, the ink supply device 102 with a frustum shaped end on the bottom of the device can decrease the amount of time it can take to re-disperse ink with settled heavy pigment particles.

Further, the re-circulation of ink back to the top of the ink supply device 102 can reduce the amount of space and complexity involved in re-circulation. In an example, the ink supply device 102 can be recirculated within itself with a pump compared to what may have previously included an ink supply with two ink holding chambers that can transfer ink contents back and forth. In an example, the use of a frustum shape in the first end 114 and second end 116 can keep the ink dispersed after the re-dispersion process using the same circulation method as described above.

In an example, the ink supply device 102 can be used without an interior bag for the ink. In an example, an ink supply device 102 without a bag can include a vent to allow pressure to equalize as ink leaves the ink supply device 102 for consumption by a printer 104. In an example, an ink supply device 102 without a bag can also include a flexible middle that can collapse as ink leaves the ink supply device 102 for consumption including consumption by a printer 104.

Figure 2:
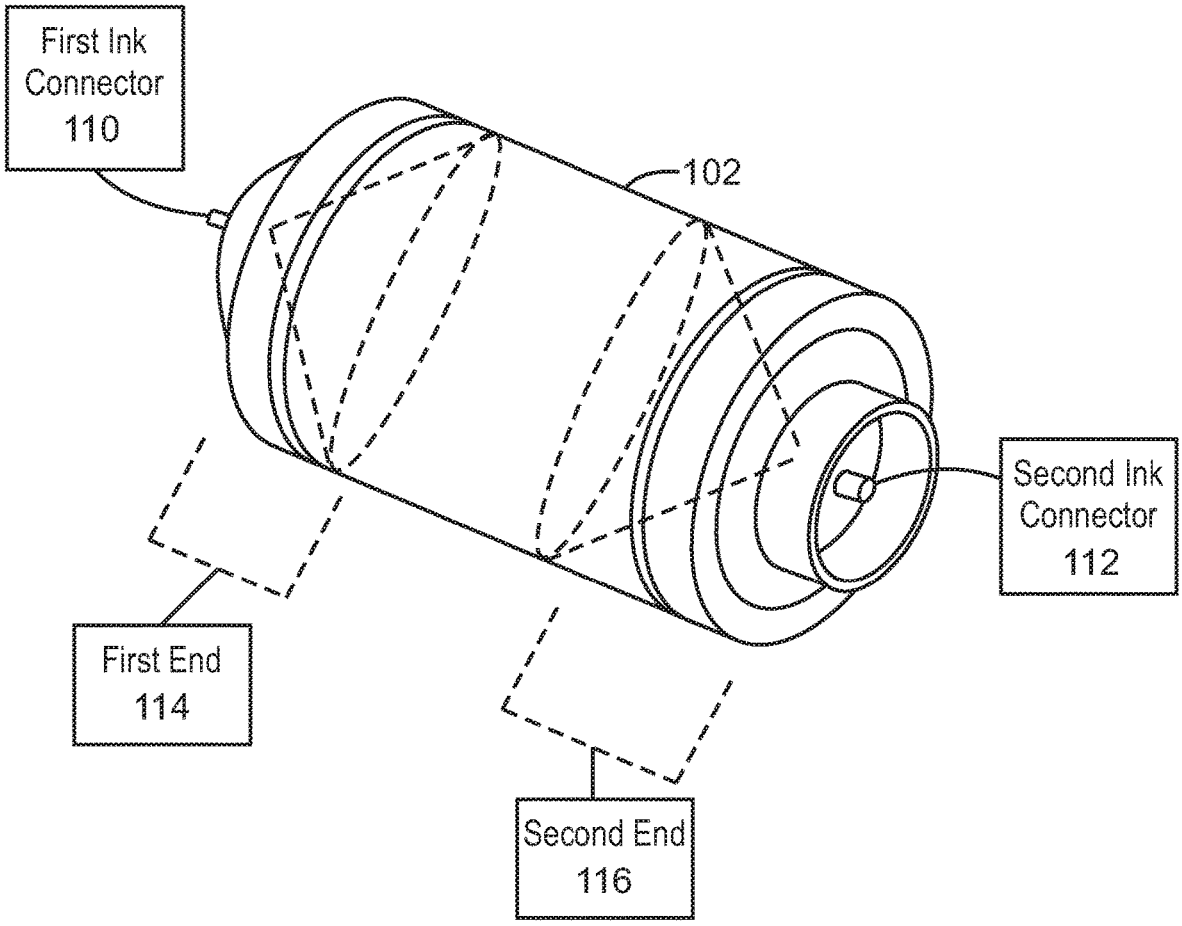
FIG. 2 is a block diagram of an example cylindrical exterior of an ink supply device.

FIG. 2 is a block diagram of an example cylindrical exterior 200 of an ink supply device 102. Like numbered items are as described in FIG. 1.

The dashed lines that can be seen through the cylindrical exterior 200 of the ink supply device 102 can represent the first end 114 and the second end 116. As discussed above, the frustum shape of the first end 114 and the second end 116 can be affected by the shape of the ink supply device 102. In an example, when the interior of an ink supply device 102 matches the cylindrical exterior 200, and the cylindrical exterior 200 is a cylinder shape, then the frustum shape can be conical.

Figure 3:
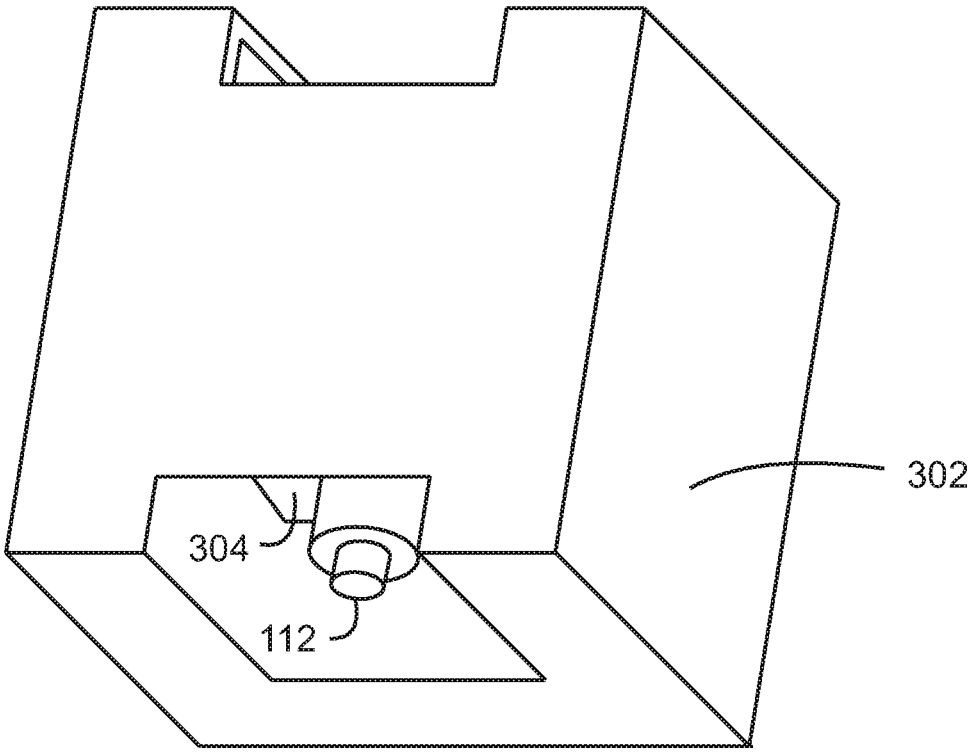
FIG. 3 is a block diagram of an example exterior of a rectangular ink supply device with an ink bag.

FIG. 3 is a block diagram of an example exterior of a cuboid ink supply device 300 with an ink bag. Like numbered items are as described in FIG. 1.

In an example, a cuboid ink supply device 300 with a rectangular exterior 302 can lead to a pyramidal frustum shape for a first end and a second end. Additionally, compared to systems that use rigid walls for holding ink and structure, an ink bag 304 can hold the ink and fit inside the interior of the cuboid ink supply device 300 to take on the frustum shaped structures of the cuboid ink supply device 300.

The ink bag 304 can join to the second ink connector 112 discussed above. Joining can these two components becoming physical linked or physically connected such that ink can flow from one to the other on the inside of both. In an example, an ink bag 304 containing ink that is joined to a second ink connector 112 has a physical connection and ink can flow from the inside of the ink bag 304 into the second ink connector 112.

In an example, the ink bag 304 can be flexible and can expand or contract depending on the ink inside. An ink bag 304 with flexibility can allow for more equal pressure to be applied to an ink while avoiding the use of a vent to an ink holding chamber. This can occur through the change in volume of the bag changing while the volume of the ink supply device may not need to change. In an example, the design of a cuboid ink supply device 300 can include a bag within more rigid walls of the rectangular exterior 302. If the ink bag 304 flexes, then the ink bag can conform to the frustum shape of the first end and second end of the rigid cuboid ink supply device.

In an example, the cuboid ink supply device 300 can include a bag having two spouts. One of the two spouts can join to a first ink connector and can be centered on one side of the ink bag 304. The second spout can join to a first ink connector and can be centered on the opposite side of the ink bag 304. An ink bag 304 can maintain a distance between the two spouts using shaped or rigid separators to keep the shape of the cuboid ink supply device 300 itself.

As discussed above, the two spouts, also referred herein as ink connectors, can be can be interchanged. In an example, fluid containing the settled heavy pigment particles can be pump-drawn from the bottom suction point and returned on top return point. Use of a frustum shape can shape a flexible bag to match the shape of a hopper. This frustum shape aids the re-circulation of ink and unsettling of any heavy particles. The funneling of more settled particles can be done through the use of the ink bag 304 assumed hopper in a frustum shape. The shaping hopper can be used to collect the heavy pigment particles over the suction point and to prevent areas of no circulation from forming in the ink bag 304.

Figure 4:
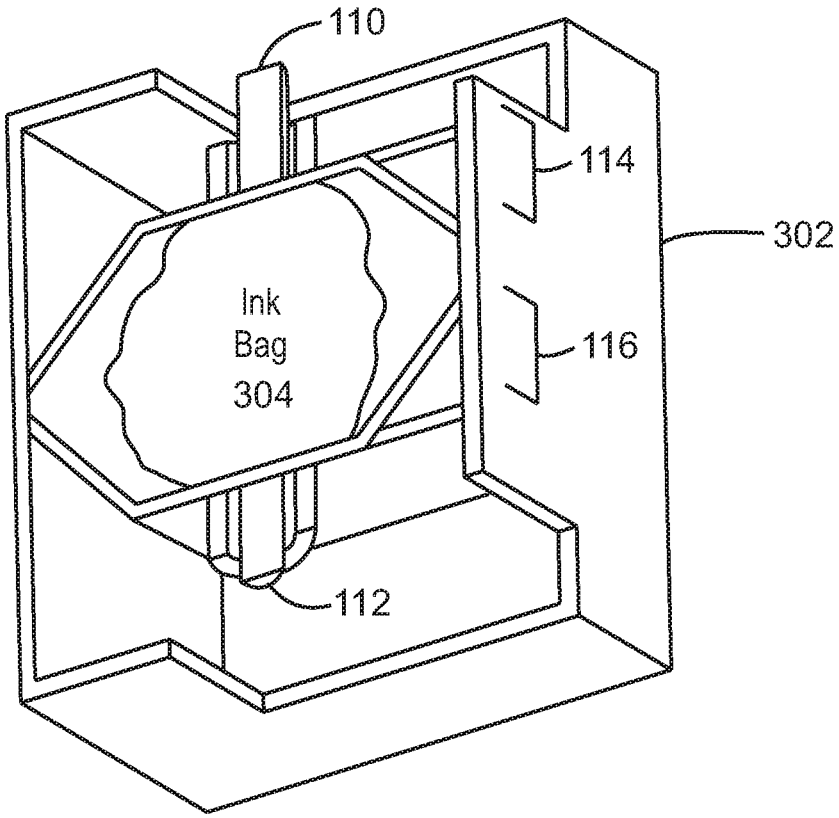
FIG. 4 is a block diagram of an example of a rectangular cross-section of an ink supply device with an ink bag.

FIG. 4 is a block diagram of an example of a cross-section of a cuboid ink supply device 400 with an ink bag. Like numbered items are as described here and as in FIGS. 1 and 3.

As described above, the cuboid ink supply device 400 can include a hollow cavity formed by rigid walls of the cuboid ink supply device 400. Within the cuboid ink supply device, an ink bag 304 with flexibility can sit on the second end 116. The frustum shaped second end and frustum shaped first end are interchangeable allowing the direction of installation to be less error prone.

Figure 5:
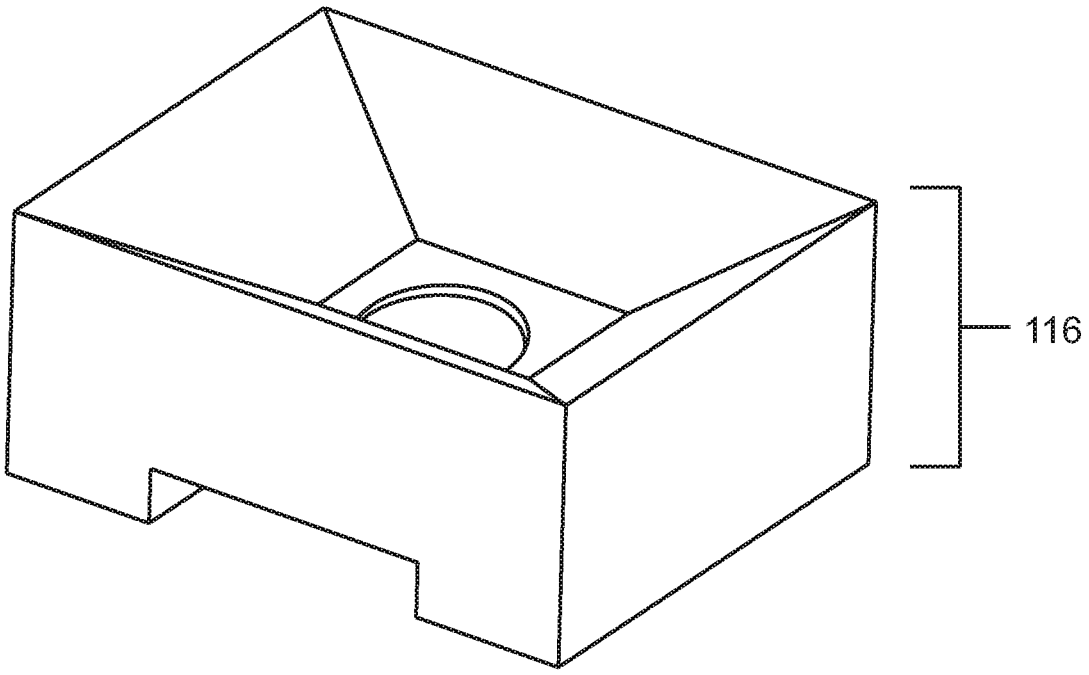
FIG. 5 is a block diagram of an example a second end of a hopper device.

FIG. 5 is a block diagram of an example a second end hopper 500 of an ink supply device. The like numbered item is as shown in FIG. 1.

The second end 116 using the second end hopper 500 can be pyramidal for cuboid ink supply devices. In an example, no ink connector may be shown for the second end of FIG. 5. The second end 116 shown can be a second end hopper 500 to funnel an ink bag of settled particles that can be aided through recirculation and redistribution.

Figure 6:
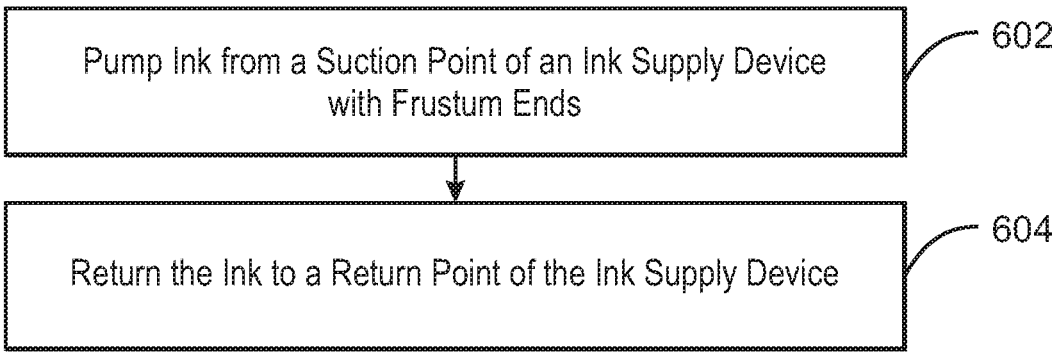
FIG. 6 is a process flow diagram of an example method for ink circulation with an ink supply device.

FIG. 6 is a process flow diagram of an example method for ink circulation with an ink supply device. The method 600 shown here can be implemented on the systems shown in FIGS. 1-5. Process flow begins at block 602.

At block 602, the method 600 can include pumping ink from a suction point of an ink supply device. The ink supply device can include a first end and a second end aligned along an axis on opposite sides of the ink supply device. As used herein, an axis is an imaginary line that can serve as a fixed reference line for placement of components including the first end and the second end. For example, if a first end and a second end are aligned along an axis on opposite sides of the ink supply device, they may both be located in a straight line where both the first end and the second end are also centered on the imaginary line, also called the axis. The first end can be frustum shaped and can include a return point. The second end can be frustum shaped and comprises the suction point.

At block 604, the method 600 can include returning the ink to the ink supply device through the return point. The return point can be the first ink connector as described above. In an example, the method 600 can include switching a position of a valve between the suction point and the return point of the ink supply device. In an example, the first position can be to route ink to the return point. In an example, the second position of the valve can be to route ink to a printer.

While the present techniques may be susceptible to various modifications and alternative forms, the examples discussed above have been shown by way of example. It may be understood that the techniques are not intended to be limited to the particular examples disclosed herein. Indeed, the present techniques include alternatives, modifications, and equivalents falling within the scope of the appended claims.

What is claimed is:

1. An ink supply system comprising:

an ink supply device with a first end and a second end located along an axis on opposite sides of the ink supply device, wherein the first end is frustum shaped, and the second end is frustum shaped;

a first ink connector attached to the first end;

a second ink connector attached to the second end, wherein the first ink connector and the second ink connector are bi-directional for ink flow in response to a threshold pressure applied; and a pump connected to the second ink connector to move ink accumulating in the second end through the second ink connector into the ink supply system.

2. The system of claim 1, comprising a valve between the pump and the first ink connector, the valve comprising a first position to route ink to the first ink connector and a second position to route the ink to a printer.

3. The system of claim 1, comprising an ink bag that fits inside the interior of the ink supply device.

4. The system of claim 3, wherein the ink bag joins to the first ink connector and the second ink connector.

5. The system of claim 4, wherein the ink bag is flexible and shrinks if the ink is removed from the inside of the ink bag.

6. The system of claim 1, wherein the ink supply device is cylindrical and the first end and the second end are a conic frustum shape.

7. An ink supply device comprising:

a first end and a second end located along an axis on opposite sides of the ink supply device, the first end is frustum shaped, the second end is frustum shaped;

a first ink connector attached to the first end; and a second ink connector attached to the second end, wherein the first ink connector and the second ink connector are bi-directional for ink flow if a threshold pressure is applied.

8. The device of claim 7, comprising an ink bag disposed in an interior of the ink supply device.

9. The device of claim 8, wherein the ink bag joins to the first ink connector and the second ink connector.

10. The device of claim 9, wherein the ink bag shrinks if ink is removed from the ink bag through the first ink connector or the second ink connector.

11. The device of claim 7, wherein the ink supply device is cylindrical, and the first end and the second end are a conic frustum shape.

12. The ink supply device of claim 7, wherein at least one of the first end and the second end is circularly frustrum shaped.

13. The ink supply device of claim 7, wherein at least one of the first end and the second end is rectangularly frustrum shaped.

14. The ink supply device of claim 7, comprising a valve that recirculates ink through the valve to the top of the ink supply device.

15. The ink supply device of claim 7, comprising a valve that recirculates ink through the valve to maintain a density of ink.

16. The ink supply device of claim 7, comprising a vent in the ink supply device to allow pressure to equalize as ink leaves the ink supply device.

17. The ink supply device of claim 7, comprising a flexible middle that can is to collapse as ink leaves the ink supply device.

18. The ink supply device of claim 7, wherein the ink supply device is contained within an exterior that hides the frustrum shape of at least one of the first end and the second end.

19. An ink circulation method with an ink supply device, comprising:

pumping ink from a suction point of the ink supply device, the ink supply device comprising a first end and a second end located along an axis on opposite sides of the ink supply device, wherein the first end is frustum shaped and comprises a return point, and wherein the second end is frustum shaped and comprises the suction point, wherein the first ink connector and the second ink connector are bi-directional for ink flow if a threshold pressure is applied; and returning the ink to the ink supply device through the return point.

20. The method of claim 19, comprising switching a position of a valve between the suction point and the return point of the ink supply device between a first position to route ink to the return point and a second position to route ink away from the return point.

* * * * *